United States Patent [19]

Brown

[11] B 3,990,652

[45] Nov. 9, 1976

[54] ADJUSTABLE WIRE CONTROL MECHANISM

[76] Inventor: Maurice H. Brown, 11655 S. Mayfield, Worth, Ill. 60482

[22] Filed: Sept. 16, 1974

[21] Appl. No.: 506,167

[44] Published under the second Trial Voluntary Protest Program on February 10, 1976 as document No. B 506,167.

[52] U.S. Cl. ..... 242/129.8; 242/147 R

[51] Int. Cl.[2] ..... B65H 49/00; B65H 59/00

[58] Field of Search ..... 242/128, 129, 129.5–129.8, 242/147, 156

[56] References Cited

UNITED STATES PATENTS

| | | | |
|---|---|---|---|
| 3,491,967 | 1/1970 | Sawyer et al. | 242/129 |
| 3,632,062 | 1/1972 | Sole | 242/147 R |
| 3,811,639 | 5/1974 | Jordan | 242/129.8 |

*Primary Examiner*—Leonard D. Christian
*Attorney, Agent, or Firm*—Kinzer, Plyer, Dorn & McEachran

[57] ABSTRACT

A device for applying generally uniform tension to wire, especially wire of fine diameter, as it is unwound over an axial end of a coil or spool of wire. The tensioning device is effective to prevent curling and twisting of the wire as it is unwound. This device is also useful in tensioning wire during high-speed winding where the wire is rapidly accelerated and decelerated, for example, during winding of a coil having a core of square or rectangular cross-section. This device is also useful in pretensioning wire before it winds around a final tensioning mechanism. The device may be used as a final and sole tensioning device on fine and ultra fine gauge wire. The tensioning device includes a disc having a plurality of radially extending filaments which protrude beyond the periphery of the axial end of the spool of wire and engage the wire as it is unwound from the spool. The tensioning device includes means to bend the filaments in the direction of uncoiling of the wire as the uncoiling resistance of the wire increases to maintain a relatively constant resistance against the wire during uncoiling.

10 Claims, 5 Drawing Figures

35

83
85
33
27
29
31
81
22
79
43
67
55
61
63
51
25
21
19
15
23
17
11
13
13
75

ADJUSTABLE WIRE CONTROL MECHANISM

SUMMARY OF THE INVENTION

This invention is concerned with an apparatus for maintaining tension on a moving wire, especially a wire that is uncoiled over the axial end of a spool of wire. It is particularly concerned with an apparatus which automatically maintains a generally uniform tension on a moving wire as the speed of the wire varies.

Discs with radially extending resilient filaments have been used for some time to apply a resistance or impedance to wire as it is uncoiled over the axial end of a spool of wire. As the wire is uncoiled from the spool, it engages and bends filaments of the disc as it moves around the end of the spool. As the speed of uncoiling increases, the frictional engagement between the wire and the filaments increases and tension on the wire becomes greater.

Problems have been encountered during the uncoiling of fine gauge wire such as wire having a thickness of about 40 gauge because the disc filaments, due to their thickness and resilience, provide too much tension or impedance during high speed uncoiling of the wire, especially high speed uncoiling when the wire is subjected to high rates of acceleration and deceleration. High rates of acceleration and deceleration of the wire may occur where coils or similar objects having cores of rectangular or square cross-section are being wound.

The apparatus of this invention maintains a generally uniform tension on wire even though the wire is uncoiled at high speeds and is subjected to high rates of acceleration and deceleration. The apparatus is also useful in maintaining tension on fime gauge wire which is being uncoiled during winding at high speeds. This invention also provides an apparatus which, while simple and economical to manufacture, reacts positively to changes in tension on the wire being uncoiled. This invention may also be used to pretension wire before it winds around a final tensioning mechanism. The device of the invention for fine and ultrafine wire, such as wire of 40 gauge and less diameter. Other advantages of this invention will be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
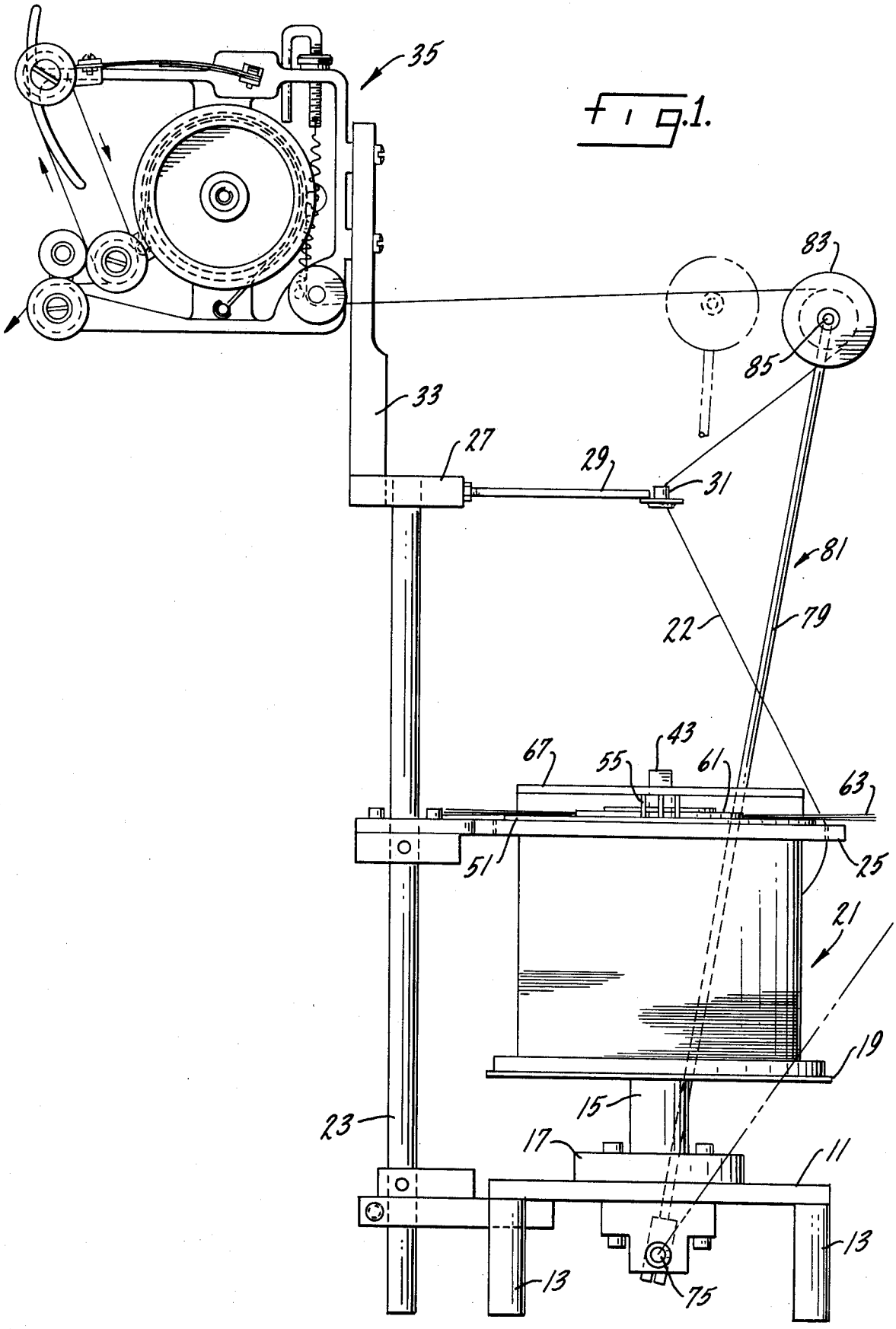
FIG. 1 is a side elevational view of an apparatus embodying the novel features of this invention.

An apparatus embodying the novel features of this invention is shown in FIG. 1 of the drawings. The apparatus includes a base 11 having supporting legs 13. A tubular upright 15 is supported on the base with the bottom thereof fitting inside a collar 17. A support plate 19 is mounted on top of the upright 15 and supports a spool 21 wound with wire 22. An upstanding post 23 is mounted on one side of the base 11. A ring 25 is cantileverly mounted on the post and fits over the upper flange of the wire spool 21. A block 27 is attached to the top of the post 23. An arm 29 extends horizontally from the block 27 and supports an eyelet 31 over the spool 21.

A bracket 33 upstanding on the block 27 supports a wire tensioning and tension indicating device 35. This /wire tensioning and tension indicating device is shown and described in my pending patent application Ser. No. 403,112, filed Oct. 3, 1973, now U.S. Pat. No. 3,837,598. The wire tensioning device 35 is not essential to the practice of the invention and may be omitted. Also, other tensioning devices may be used, if desirable, in place of the tensioning device 35 shown in the drawing.

A vertical shaft 41 (FIGS. 2 through 5) extends through the tubular upright 15 and through and above the top of the wire spool 21. A collar 43 of non-circular cross-section, preferably square, is fastened to the upper end of the shaft which is positioned above the top of the spool. Surrounding the shaft 41 is cylindrical sleeve 47 which has a portion 49 at its upper end formed of non-circular, preferable square, outer cross-section. A circular plate 51 fits over the non-circular portion 49 of the cylindrical sleeve 47 and has a center opening 53 of cross-section similar to that of portion 49 which functions to lock the circular plate against rotation relative to the cylindrical sleeve. A number of upstanding posts 55 are attached to the upper surface of the circular plate 51 and are arranged in circle location inwardly of the periphery of the plate.

Figure 2:
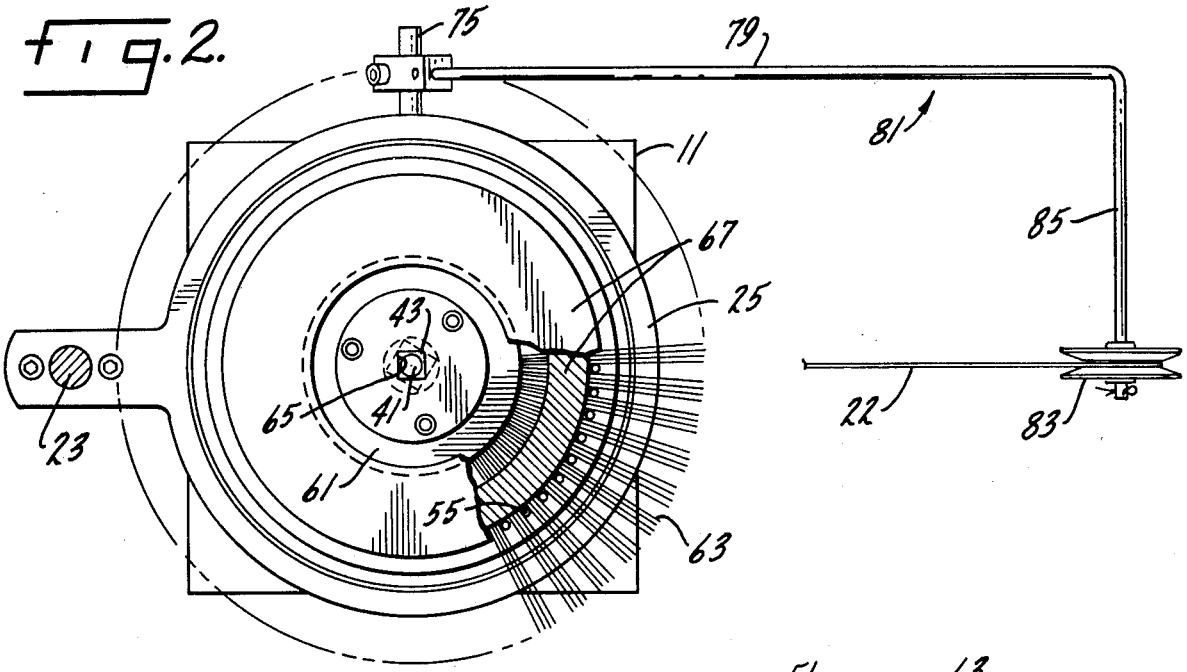
FIG. 2 is a partial top plan view of the apparatus of FIG. 1 with portions thereof broken away from clarity of illustration.
Figure 3:
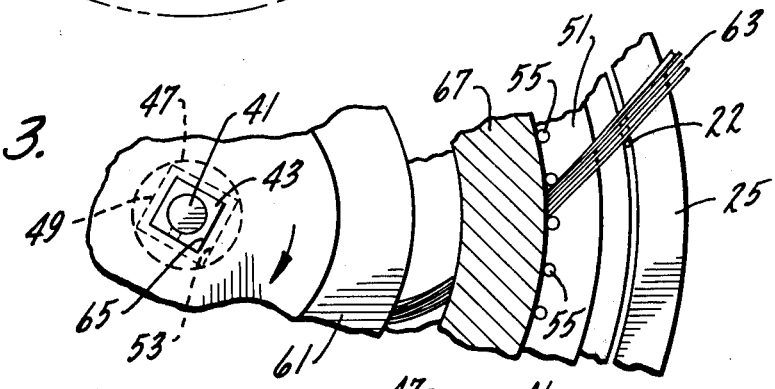
FIG. 3 is a partial enlarged view of the apparatus of FIG. 2 shown in a different position of adjustment.
Figure 4:
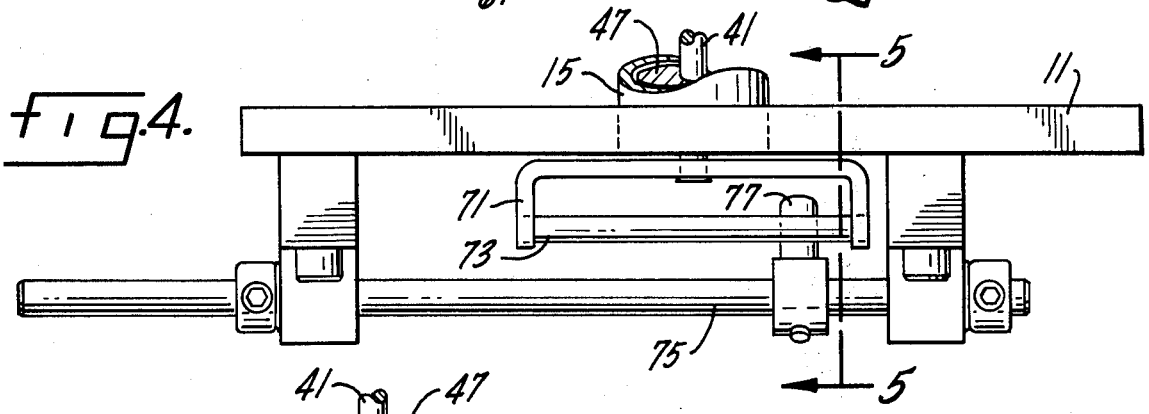
FIG. 4 is an enlarged side elevational view of a portion of the apparatus of FIG. 1.
Figure 5:
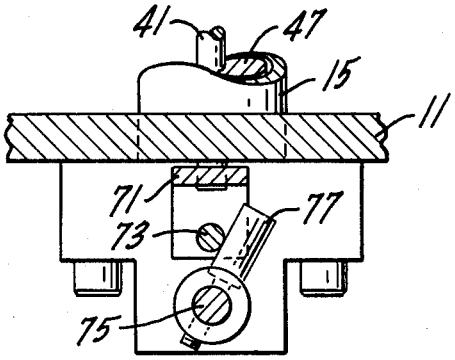
FIG. 5 is a view taken along line 5-5 of FIG. 4.

A circular disc 61 having a plurality of radially extending, resiliently flexible filaments 63 extending therefrom is mounted over the circular plate 51 with the filaments being sufficiently long so as to extend between the posts 55. The filaments may be spaced uniformly around the periphery of the disc or they may be bunched in groups as shown in FIGS. 2 and 3 of the drawings so that each bunch of filaments will extend between a pair of posts 55. The disc has a center opening 65 of cross-section complimentary so that of the collar 43 of the vertical shaft 41 so that upon positioning of the disc over the end of the shaft 41, the disc will rotate with the shaft 41. A ring-shaped weight 67 rests on the tops of the posts 55.

The lower end of the shaft 41 is affixed to a clevis 71 having a cross shaft 73. A horizontal shaft 75 is journaled beneath the base 11. This horizontal shaft extends outwardly of the base and is positioned close to the axis of the vertical shaft 41. A stub arm 77 is adjustably affixed to the shaft 75 so that it can be secured to the shaft at any selected location along the length thereof. The stub shaft 77 is of sufficient length to engage the cross shaft 73 of the clevis 71. The end of one leg 79 of an L-shaped arm 81 is fastened to the portion of the horizontal shaft 75 located outwardly of the base 11. A sheave 83 is mounted to the end of the other leg 85 of the L-shaped arm. The sheave is aligned with the vertical shaft 41 and the eyelet 31.

The use, operation and function of this invention are as follows:

The wire 22 which is to be uncoiled from the spool 21 is pulled between the flange of the spool and the retaining ring 25, throught the eyelet 31 and around a sheave 83 of the arm 81. From there the wire is threaded through the tensioning and tension indicating device 35 in the manner shown in the drawings. From the device 35, the wire is pulled to the coil, transformer or other object around which it is wound. As the wire 22 is unwound from the reel 21 over the axial end thereof it will engage the filaments 63 and bend these filaments in the direction of uncoiling of the wire. Since the filaments 63 are formed in bunches wih each bunch being positioned between posts 55 of the plate 51, the action of the wire against the filaments will cause them to bend around the posts 55 thereby creating a drag on or resistance against the uncoiling movement of the wire 22. In this regard, the posts 55 function as fulcrums to bring about bending of the filaments.

As the speed of uncoiling of the wire 22 increases, the drag or friction caused by the filaments 63 will increase. However, increased tension or impediment of the wire 22 will be reflected in movement of the sheave arm 81 between the positions shown in solid line and in phantom in FIG. 1 thereby rotating shaft 75. Rotation of shaft 75 will move stub arm 77 which is in contact with cross arm 73 of clevis 71. Thus, rotation of the shaft 75 will cause rotation of the clevis 71 and thereby rotate vertical shaft 41. Rotation of shaft 41 will be transmitted through the collar 43 of the shaft to the disc 61. Rotation of the disc 61 will cause the filaments 63 to bend about the posts 55 which function as fulcrums with the bending of the filaments being in the direction of uncoiling of the wire. Bending of the filaments will reduce the amoung of tension or drag applied to the wire 22 thereby maintaining a more or less constant tension on the wire during uncoiling.

If the wire 22 is uncoiled in a counter-clockwise direction as shown in FIGS. 2 and 3, the disc 61 is rotated in a clockwise direction so that the filaments 63 will bend in the direction of uncoiling of the wire. If the wire from a particular reel uncoils in a clockwise direction, then the stub arm 77 can be moved to the opposite diametric side of the vertical shaft 41 so the rotation of the shaft 75 upon movement of the arm 81 will rotate the shaft 41 in a counter-clockwise direction. Thus, the apparatus of this invention can be easily adjustable for spools of wire which uncoil in either direction. Also, the amount of rotation of the shaft 41 for a given angular movement of the arm 81 can be varied by moving the stub arm 77 along the shaft 75 relative to the cross arm 73.

Although the use of the arm 81 is the preferred means of causing rotation of the disc 61, since the arm responds directly to any change in tension in the wire 22, it should be understood that other means could be employed to rotate the disc 61 and thus bend the filaments 63 as the tension on the wire changes. For example, the arm 81 could be replaced by a rotary solenoid or any other means of varying the rotation of the disc in accordance with the changes and the tension applied to the wire. Thus, the scope of the invention should not be limited except by a liberal interpretation of the claims appended hereto.

I claim:

1. A wire tensioning device including a disc adapted to be mounted on an axial end of a spool of wire, said disc having a plurality of radially extending resilient filaments that protrude beyond the periphery of the axial end of the spool of wire, said filaments engaging the wire as it is unwound from the spool over the axial end of the spool to thereby apply a resistance to the uncoiling of said wire, and means to bend said filaments in the direction of uncoiling of said wire as the uncoiling resistance increases to thereby maintain a relatively constant resistance against the wire during uncoiling.

2. The wire tensioning device of claim 1 in which said means to bend said filaments in the direction of uncoiling of said wire includes fulcrum means located between said filaments and intermediate their ends and means to rotate said disc to move said filaments against said fulcrum means to thereby bend said filaments.

3. The wire tensioning device of claim 2 in which said fulcrum means are posts which are arranged in a circle.

4. The wire tensioning device of claim 3 in which said wire engages said filaments outwardly of said fulcrum means.

5. The wire tensioning device of claim 2 in which said means to rotate said disc includes a pivotally mounted arm engaged by said wire and means connecting said arm and said disc to rotate said disc upon pivotal movement of said arm.

6. The wire tensioning device of claim 5 which said means connecting said arm and said disc include a shaft fixed to said arm and forming the pivotal axis for said arm, a shaft fixed to said disc and extending at right angles to said arm shaft, and means connecting said shafts so that rotation of said pivotal arm shaft will bring about rotation of said disc shaft.

7. The wire tensioning device of claim 6 in which said means connecting said shafts includes a stub arm fastened to said pivotal arm shaft and a radially extending arm fastened to said disc shaft, said arms being positioned to engage each other so that rotation of said pivotal arm shaft will bring about rotation of said disc shaft.

8. The wire tensioning device of claim 7 in which said stub arm is adjustably relocatable along said shaft at a plurality of positions on diametrically opposite sides of said disc shaft.

9. The wire tensioning device of claim 1 in which a retaining ring is mounted over the axial end of said spool to retain said wire in contact with said filaments.

10. The wire tensioning device of claim 3 in which a retaining ring is mounted over the axial end of said spool to retain said wire in contact with said filaments with said retaining ring being located outwardly of said posts.

* * * * *